US011172735B2

(12) United States Patent
Puglia

(10) Patent No.: US 11,172,735 B2
(45) Date of Patent: Nov. 16, 2021

(54) METHOD OF USING A MAGNETIC BUTTON FOR USE WITH A PREEXISITING BUTTON AND A PREEXISITING BUTTON HOLE ASSOCIATED WITH THE PREEXISITING BUTTON OF AN ARTICLE OF CLOTHINGS

(71) Applicant: David Puglia, Lake Grove, NY (US)

(72) Inventor: David Puglia, Lake Grove, NY (US)

( * ) Notice: Subject to any disclaimer, the term of this patent is extended or adjusted under 35 U.S.C. 154(b) by 2 days.

(21) Appl. No.: 16/873,604

(22) Filed: May 19, 2020

(65) Prior Publication Data

US 2020/0281326 A1 Sep. 10, 2020

Related U.S. Application Data

(62) Division of application No. 15/731,562, filed on Jun. 28, 2017, now Pat. No. 10,716,366.

(51) Int. Cl.

| | |
|---|---|
| ***A41F 1/00*** | (2006.01) |
| ***A44B 1/08*** | (2006.01) |
| ***A41B 1/10*** | (2006.01) |
| ***A44B 1/06*** | (2006.01) |
| *A44B 1/10* | (2006.01) |

(52) U.S. Cl.

CPC ..... *A44B 1/08* (2013.01); *A41B 1/10* (2013.01); *A41F 1/002* (2013.01); *A44B 1/06* (2013.01); *A44D 2203/00* (2013.01); *Y10T 24/32* (2015.01)

(58) Field of Classification Search

CPC ..... A41F 1/002; A44D 2203/00; A44B 1/08; A44B 1/14; Y10T 24/32; Y10T 24/367; Y10T 24/3672

See application file for complete search history.

(56) References Cited

U.S. PATENT DOCUMENTS

| | | | |
|---|---|---|---|
| 1,430,008 | A | 9/1922 | Eddy |
| 2,483,031 | A | 9/1949 | Avedon |
| 5,974,634 | A | 11/1999 | Eisenpresser |
| 7,178,207 | B2 | 2/2007 | Wong et al. |
| 7,992,264 | B2 | 8/2011 | Abadi |
| 8,464,377 | B1 | 6/2013 | Carson et al. |
| 2003/0154576 | A1 | 8/2003 | Mirharooni |

*Primary Examiner* — Robert Sandy
*Assistant Examiner* — Michael S Lee
(74) *Attorney, Agent, or Firm* — Bernard S. Hoffman

(57) ABSTRACT

A method for using a magnetic button used with a preexisting button and a preexisting button hole associated with the preexisting button of an article of clothing. The magnetic button includes a female portion and a male portion. The female portion attaches to the preexisting button of the article of clothing, and the male portion is inserted into the preexisting button hole of the article of clothing. The male portion is magnetic, while the female portion is magnetic attractive, and being so, a location position of the male portion and the female portion are selective for allowing a user to merely put the male portion and the female portion together in a comfortable location by virtue of the female portion being magnetically attractive to the male portion being magnetic.

21 Claims, 6 Drawing Sheets

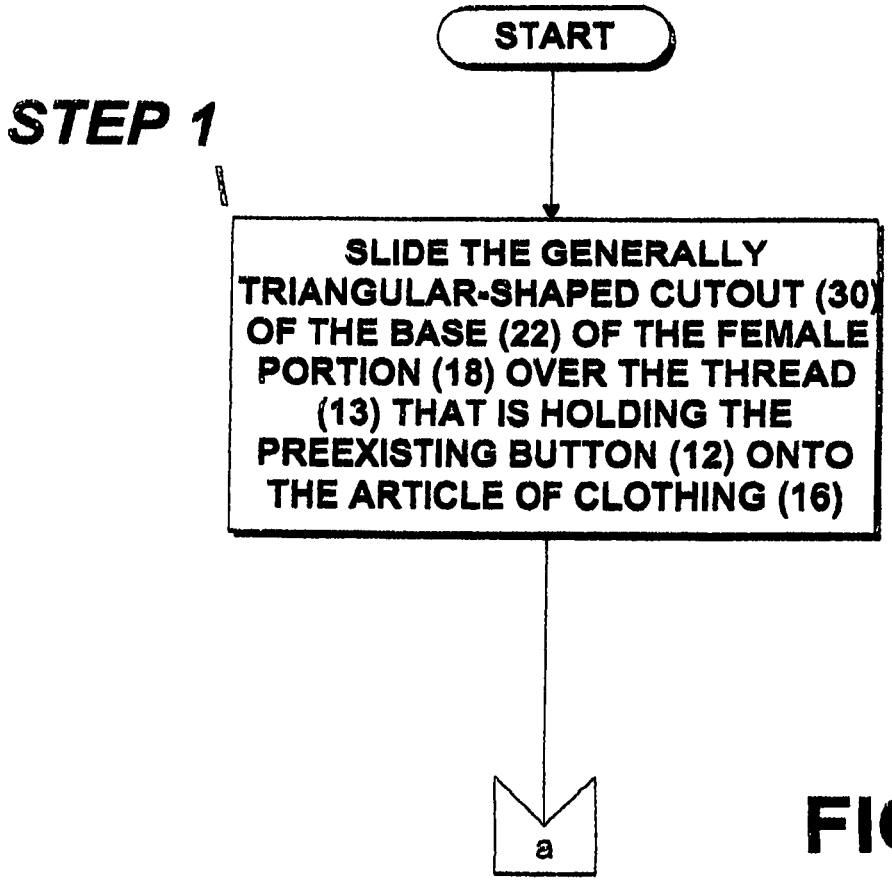
FIG. 9-A

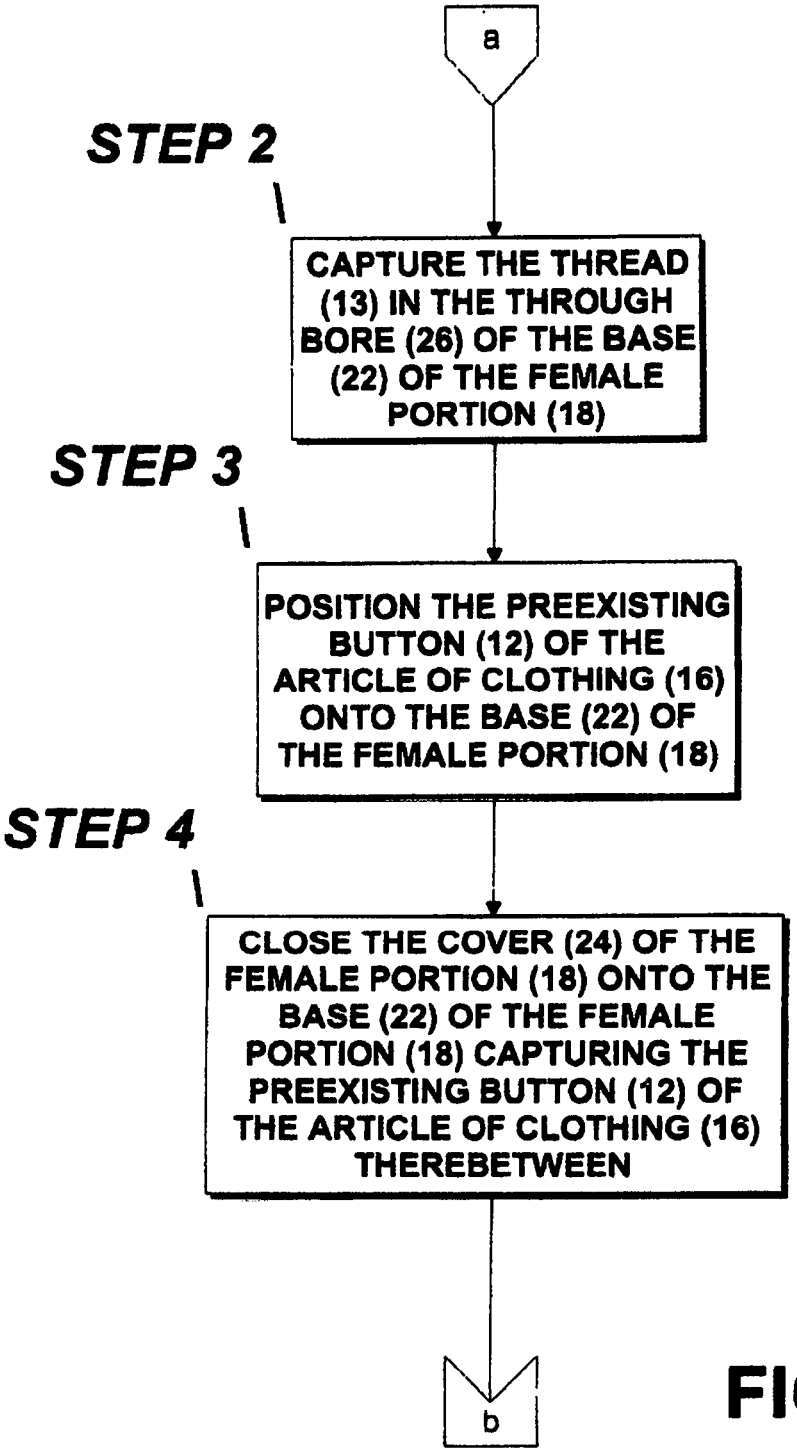
FIG. 9-B

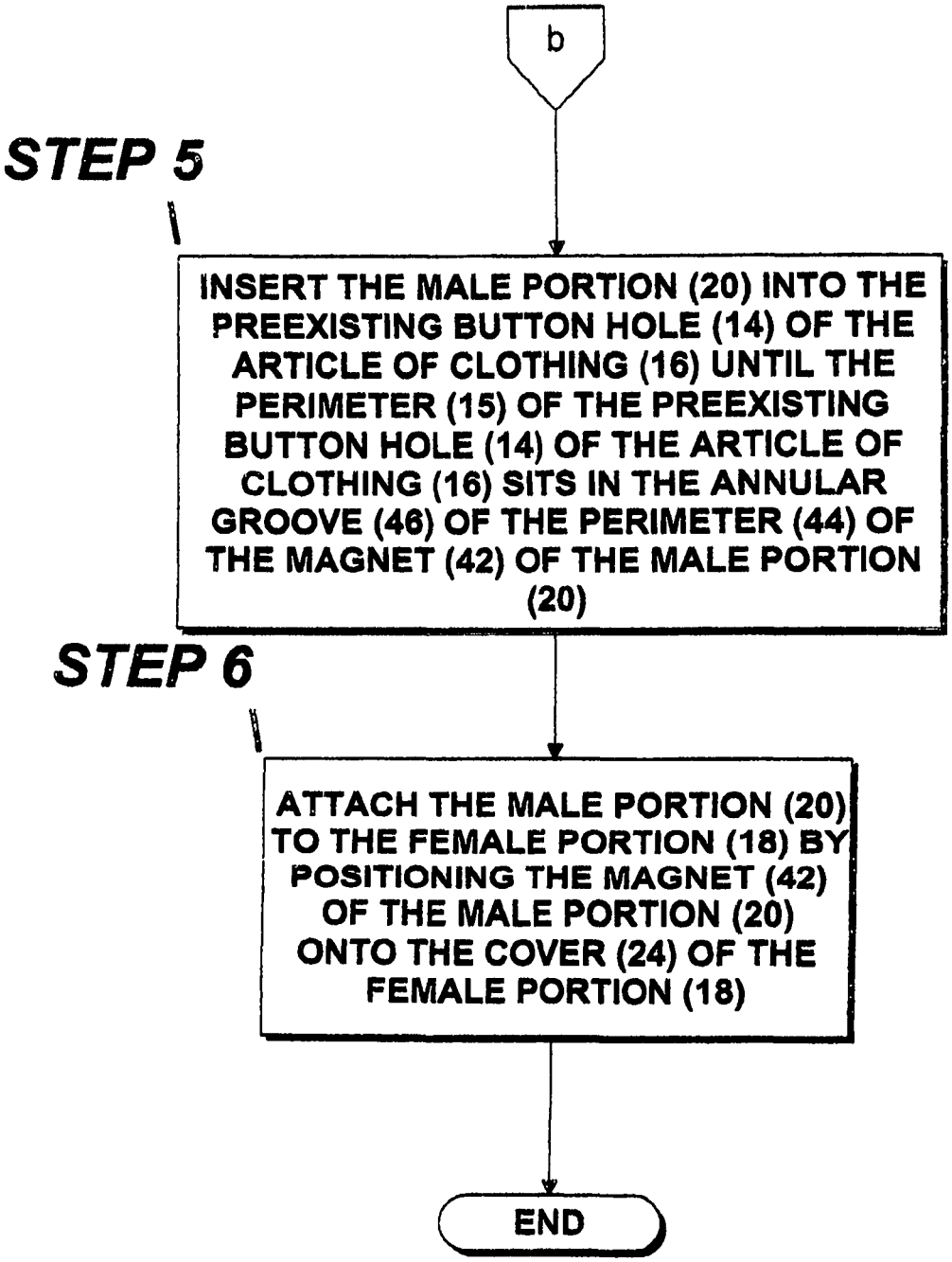
FIG. 9-C

METHOD OF USING A MAGNETIC BUTTON FOR USE WITH A PREEXISITING BUTTON AND A PREEXISITING BUTTON HOLE ASSOCIATED WITH THE PREEXISITING BUTTON OF AN ARTICLE OF CLOTHINGS

CROSS REFERENCE TO RELATED APPLICATIONS

The instant non-provisional patent application is a divisional non-provisional patent application of non-provisional patent application Ser. No. 15/731,562, filed on 28 Jun. 2017, in group 3677 by David Puglia, and entitled MAGNETIC BUTTON FOR USE WITH A PREEXISTING BUTTON AND A PREEEXISTING BUTTON HOLE ASSOCCIATED WITH THE PREEXISTING BUTTON OF AN ARTICLE OF CLOTHING, and which contains subject matter from provisional patent application No. 62/285,460, filed on 30 Oct. 2015, by David Puglia, for a MAGNETIC ADJUNCT BUTTON, and incorporated herein in their entireties by reference thereto.

BACKGROUND OF THE INVENTION

Field of the Invention

The embodiments of the present invention relate to a magnetic button for use with a preexisting button and a preexisting button hole associated with the preexisting button of an article of clothing, and more particularly, the embodiments of the present invention relate to a method of using a magnetic button for use with a preexisting button and a preexisting button hole associated with the preexisting button of an article of clothing.

Description of the Prior Art

Disabled people can have difficulty buttoning a conventional button if their handicap affects the dexterity of their hands. This makes it quite difficult for them to button the buttons on their clothing, and to do so, without damaging the buttons in the process.

Also, at times a neck size of a person gets larger making the conventional collar button and button-hole combination almost impossible to use, and if useable, it could involve some pain.

Thus, there exists a need for an innovation that will alleviate these problems.

Numerous innovations for magnetic fasteners for varying uses have been provided in the prior art, which will be described below in chronological order to show advancement in the art. Even though these innovations may be suitable for the specific individual purposes to which they address, however, they differ from the embodiments of the present invention in that they do not teach a magnetic button for use with a preexisting button and a preexisting button hole associated with the preexisting button of an article of clothing.

U.S. Pat. No. 1,430,008 to Eddy

U.S. Pat. No. 1,430,008—issued to Eddy on Sep. 26, 1922 in U.S. class 24 and subclass 102SL—teaches a separable button having laterally separable posts. One post has an inwardly turned over crescent shaped lip and spring arms formed integral with the post. The other post has a circular lip adapted to be forced by the spring arms and under the crescent-shaped lip on the first mentioned post. A button head is pivotally secured to each post, whereby the separable members of the button are locked together against a direct pull apart of the members.

U.S. Pat. No. 2,483,031 to Avedon

U.S. Pat. No. 2,483,031—issued to Avedon on Sep. 27, 1949 in U.S. class 24 and subclass 104—teaches a cuff-link that includes a first part and a second part that are adapted to be assembled in longitudinal relation. Each part has an end-plate and an armature connected to the end-plate of the first part. The armature is made of material that is permeable to magnetic flux and which has little residual magnetism. The end plate of the second part is connected to a pole cup of the material. The pole cup has a lateral base and a longitudinal wall, a permanent magnet located in said pole cup and abutting the inner face of said lateral base. The permanent magnet has a longitudinal wall that is separated by a lateral space from the inner face of the longitudinal wall of the cup. Further including is a pole plate that abuts the outer face of the permanent magnet. The pole plate has an outer face that is aligned with the end-wall of the longitudinal wall of the cup. The pole plate is made of the material and is separated from the inner face of the longitudinal wall of the cup by an air gap that is of much less width than the lateral space so that substantially all the magnetic flux passes through the air-gap when the parts of the cuff-link are separated. The armature has an end-wall that abuts the end-wall of the longitudinal wall and which abuts the outer face of the pole plate to bridge the air-gap when the parts of the cuff-link are assembled. The assembled armature and pole plate are located between the end plates when the parts of the cuff-link are assembled. The assembled armature and pole plate have a lateral air space whose outer edge is close to the air-gap, so that when the parts of the cuff-link are assembled, the flux enters the armature and leaves the armature close to the air gap and there is then substantially zero flux through the air gap.

U.S. Pat. No. 5,974,634 to Eisenpresser

U.S. Pat. No. 5,974,634—issued to Eisenpresser on Nov. 2, 1999 in U.S. class 24 and subclass 303—teaches a decorative multi-use magnetic button construction that includes a decorative shell having a cavity therein that contains a first magnet that contacts the base which contacts the outer surface of, for example, a human ear or garment, and is held in place on the ear by attraction to a second magnet on the opposite side of the ear. This provides a structure that is attached to the ear or garment and allows interchangeable decorative shells to be alternatively and permanently connected to the base. An additional embodiment discloses an outer shell having curled edges for being more tightly attached to the base.

United States Patent Application Publication Number 20030154576 to Mirharooni United States Patent Application Publication Number 2003/0154576—published to Mirharooni on Aug. 21, 2003 in U.S. class 24 and subclass 41.1—teaches a cuff-link including any mobile two-piece button of metal or any other solid material, which is used to secure the cuffs of a shirt or other item of clothing together, by way of a magnetized connection. To secure the cuff-link, the two pieces of the cuff-link are inserted into the two button-holes in a cuff, and the positive magnet is secured to the negative magnet by simply touching them together. To release the cuff-link, the wearer pulls gently on the two pieces, releasing the magnetic force holding them together.

U.S. Pat. No. 7,178,207 to Wont et al

U.S. Pat. No. 7,178,207—issued to Wong et al. on Feb. 20, 2007 in U.S. class 24 and subclass 303—teaches a magnetic fastener including a first detachable fastening member and a second detachable fastening member. The first and the second detachable fastening members, respectively, include first and second magnetic coupling surfaces that are magnetically attracted towards each other along an axial magnetic coupling direction. The magnetic fastener includes guarding apparatus adapted to resist relative lateral movements between the first and the second magnetic coupling surfaces when the first and the second fastening members are under magnetic coupling. The first and second fastening members include co-operative catching apparatus adapted to resist disengagement of the first and second fastening members generally along the axial magnetic coupling direction when the first and second fastening members are simultaneously under magnetically coupling and subject to lateral tensions applied transversely to the axial magnetic coupling direction.

U.S. Pat. No. 7,992,264 to Abadi

U.S. Pat. No. 7,992,264—issued to Abadi on Aug. 9, 2011 in U.S. class 24 and subclass 303—teaches a clasp including a first magnet and a second magnet. The clasp is closed by coupling the first magnet and the second magnet and the clasp is opened by uncoupling the first magnet and the second magnet.

U.S. Pat. No. 8,464,377 to Carson et a I

U.S. Pat. No. 8,464,377—issued to Carson et al. on Jun. 18, 2013 in U.S. class 5 and subclass 498—teaches a linen fastener including a hub and a magnet at least partially disposed within the hub. The hub is arranged to be placed against a first exterior surface of layered linens so that magnetic force from the magnet engages an element located on a second exterior surface of the layered linens, opposite the first exterior surface, to clamp the layered linens between the hub and the element. A method of fastening a linen using a fastener including a hub and a magnet at least partially disposed within the hub includes placing the hub against a first exterior surface of the layered linens, engaging with magnetic force from the magnet an element located on a second exterior surface of the layered linens, opposite the first exterior surface, and clamping the layered linens between the hub and the element.

It is apparent that numerous innovations for magnetic fasteners for varying uses have been provided in the prior art, which are adapted to be used. Furthermore, even though these innovations may be suitable for the specific individual purposes to which they address, however, they would not be suitable for the purposes of the present invention as heretofore described, namely, a magnetic button for use with a preexisting button and a preexisting button hole associated with the preexisting button of an article of clothing.

SUMMARY OF THE INVENTION

Thus, it is an object of the embodiments of the present invention to provide a method of using a magnetic button for use with a preexisting button and a preexisting button hole associated with the preexisting button of an article of clothing, which avoids the disadvantages of the prior art.

Briefly stated, another object of the embodiments of the present invention is to provide a method for using a magnetic button with a preexisting button and a preexisting button hole associated with the preexisting button that is held onto an article of clothing by a thread, and the preexisting button hole has a perimeter. The method includes the steps of sliding a generally triangular-shaped cutout of a base of a female portion of the magnetic button over the thread that is holding the preexisting button onto the article of clothing, capturing the thread in a central through bore of the base of the female portion, positioning the preexisting button of the article of clothing onto the base of the female portion, closing a cover of the female portion onto the base of the female portion capturing the preexisting button of the article of clothing therebetween, inserting a male portion of the magnetic button into the preexisting button hole of the article of clothing until the perimeter of the preexisting button hole of the article of clothing sits in an annular groove of a perimeter of a magnet of the male portion of the magnetic button, and attaching the male portion to the female portion by positioning the magnet of the male portion onto the cover of the female portion.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawings.

BRIEF DESCRIPTION OF THE FIGURES OF THE DRAWING

The figures of the drawing are briefly described as follows:

FIGS. 9A-9C are a flow chart of the method of using the magnetic button with a preexisting button and a preexisting button hole associated with the preexisting button that is held onto the article of clothing by thread.

LIST OF REFERENCE NUMERALS UTILIZED IN THE FIGURES OF THE DRAWING

Introductory

Figure 1:
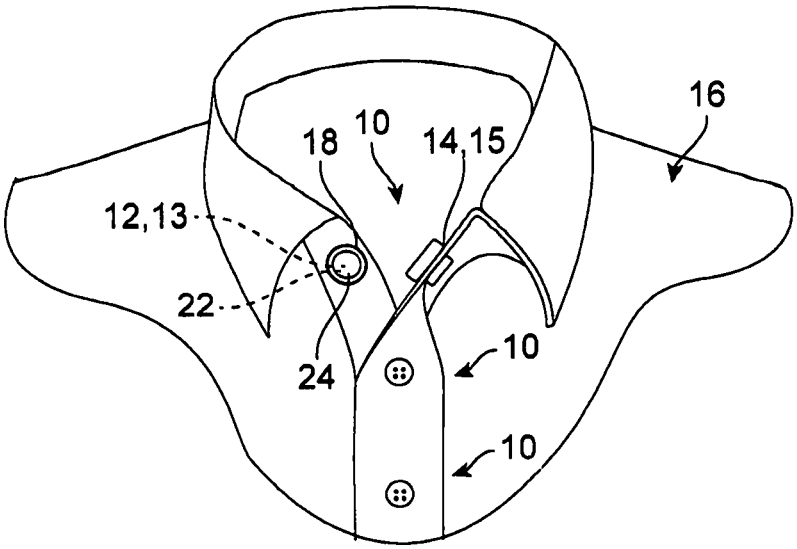
FIG. 1 is a diagrammatic perspective view of the magnetic button of the embodiments of the present invention used with a preexisting button and a preexisting button hole associated with the preexisting button of an article of clothing.

10 magnetic button of embodiments of present invention for use with preexisting button 12 and preexisting button hole 14 associated with preexisting button 12 of article of clothing 16

12 preexisting button of article of clothing 16

13 thread of preexisting button 12 of article of clothing 16

14 preexisting button hole of article of clothing 16

15 perimeter of preexisting button hole 14 of article of clothing 16

16 article of clothing

Overall Configuration of Magnetic Button 10

18 female portion of magnetic button 10 for attaching to preexisting button 12 of article of clothing 16

20 male portion of magnetic button 10 for inserting into preexisting button hole 14 of article of clothing 16

Specific Configuration of Female Portion 18

22 base of female portion 18

24 cover of female portion 18

26 central through bore of base 22 of female portion 18

28 perimeter of base 22 of female portion 18

30 generally triangular-shaped cutout of base 22 of female portion 18

32 pair of expansion through slots 32 of base 22 of female portion 18

34 perimeter of cover 24 of female portion 18

36 living hinge of cover 24 of female portion 18

38 blind recess of cover 24 of female portion 18 for receiving preexisting button 12 of article of clothing 16

Specific Configuration of Male Portion 20

40 base of male portion 20 for replicating button by having four blind bores 41

41 four blind bores of base 40 of male portion 20

42 magnet of male portion 20

44 perimeter of magnet 42 of male portion 20

46 annular groove of perimeter 44 of magnet 42 of male portion 20 for receiving perimeter 15 of preexisting button hole 14 of article of clothing 16 for maintaining magnet 42 of male portion 20 in preexisting button hole 14 of article of clothing 16

DETAILED DESCRIPTION OF THE PREFERRED EMBODIMENTS

Introductory

Figure 2:
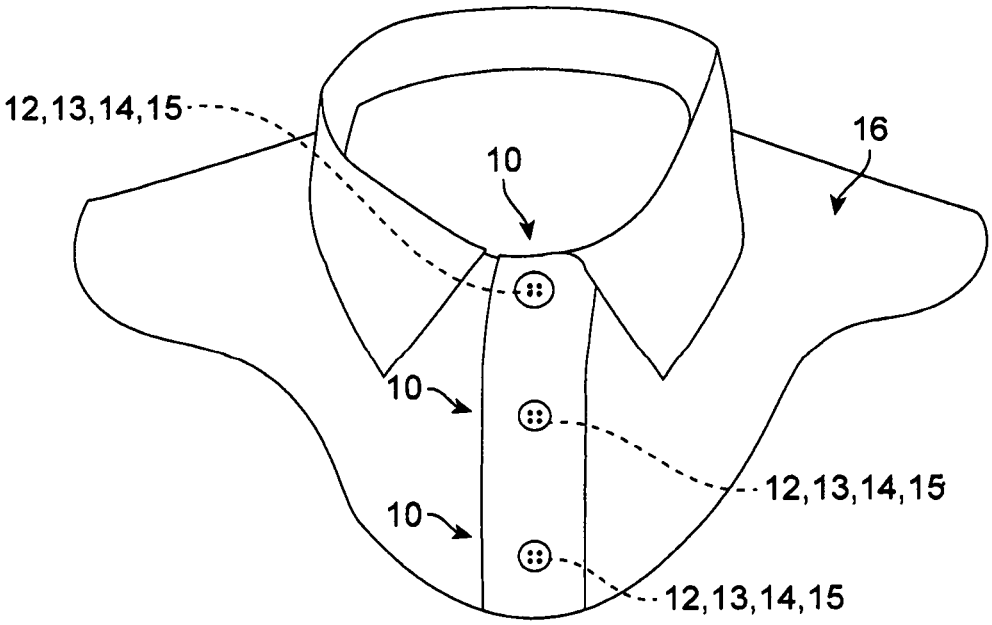
FIG. 2 is a diagrammatic perspective view of the magnetic button of the embodiments of the present invention used with a preexisting button and a preexisting button hole associated with the preexisting button of an article of clothing.
Figure 3:
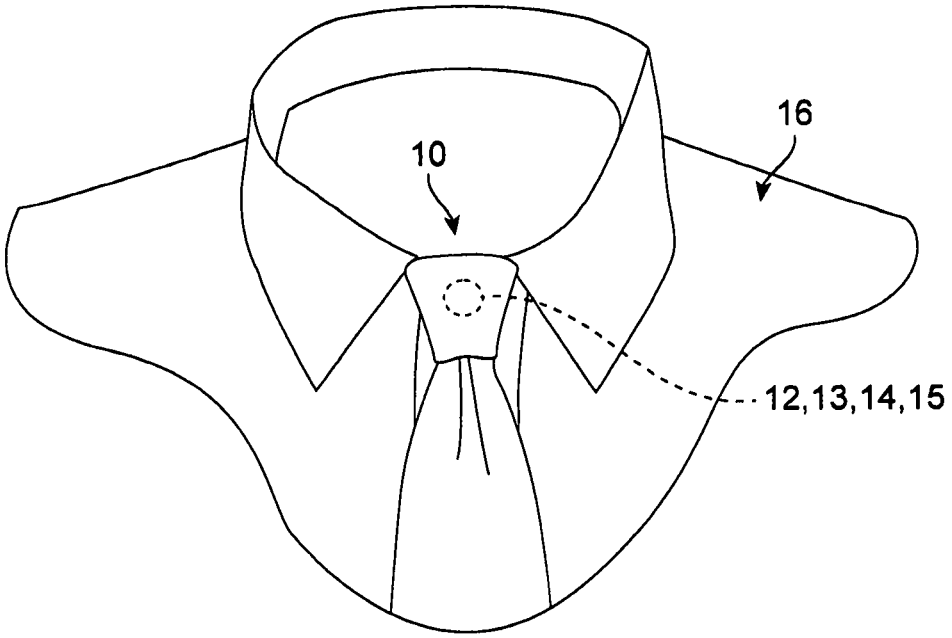
FIG. 3 is a diagrammatic perspective view of the magnetic button of the embodiments of the present invention used with a preexisting button and a preexisting button hole associated with the preexisting button of an article of clothing.

Referring now to the figures of the drawing, where like numerals indicate like parts, and particularly to FIGS. 1-3, a magnetic button is generally shown at 10 for use with a preexisting button 12 that is held on by thread 13 and a preexisting button hole 14 having a perimeter 15 and associated with the preexisting button 12 of an article of clothing 16.

Overall Configuration of the Magnetic Button 10

Figure 4:
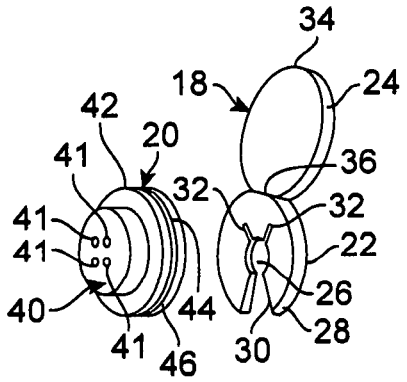
FIG. 4 is an enlarged and exploded diagrammatic perspective view of the magnetic button of the embodiments of the present invention taken from the front thereof.
Figure 5:
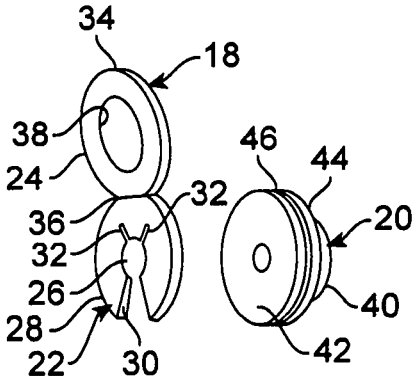
FIG. 5 is an enlarged and exploded diagrammatic perspective view of the magnetic button of the embodiments of the present invention taken from the rear thereof.

The overall configuration of the magnetic button 10 can best be seen in FIGS. 4 and 5, and as such, will be discussed with reference thereto.

The magnetic brush 10 comprises a female portion 18 and a male portion 20. The female portion 18 is for attaching to the preexisting button 12 of the article of clothing 16, and the male portion 20 is for inserting into the preexisting button hole 14 of the article of clothing 16. The male portion 20 is magnetic, while the female portion 18 is magnetic attractive, and being so, a location position of the male portion 20 and the female portion 18 are selective for allowing a user to merely put the male portion 20 and the female portion 18 together in a comfortable location by virtue of the female portion 18 being magnetically attractive to the male portion 20 being magnetic.

Specific Configuration of the Female Portion 20

The specific configuration of the male portion 20 can best be seen in FIGS. 4 and 5, and as such, will be discussed with reference thereto.

The female portion 20 includes a base 22 and a cover 24.

The base 22 of the female portion 18 is disk-shaped, and has a central through bore 26, a perimeter 28, a generally triangular-shaped cutout 30, and a pair of expansion through slots 32 extending slightly radially outwardly from, and opening into, the central through bore 26 of the base 22 of the female portion 18, in a direction opposite to the generally triangular-shaped cutout 30 of the base 22 of the female portion 18.

The generally triangular-shaped cutout 30 of the base 22 of the female portion 18 extends-divergently from, and opens into, the central through bore 26 of the base 22 of the female portion 18 to, and opens into, the perimeter 28 of the base 22 of the female portion 18, and is for receiving the thread 13 holding the preexisting button 12 to the article of clothing 16 for maintaining the base 22 of the female portion 18 on the preexisting button 12 of the article of clothing 16.

The cover 24 of the female portion 18 is disk-shaped to match that of the base 22 of the female portion 18. has a perimeter 34 that is attached to the perimeter 28 of the base 22 of the female portion 18 by a living hinge 36, and is made from a magnetically attractive material.

The cover 24 of the female portion 18 further has a blind recess 38 that is circular, extends therein concentrically to the perimeter 34 of the cover 24, and is for receiving the preexisting button 12 of the article of clothing 16 when the cover 24 of the female portion 18 is closed over the base 22 of the female portion 18.

Specific Configuration of the Male Portion 20

The specific configuration of the male portion 20 can best be seen in FIGS. 4 and 5. and as such, will be discussed with reference thereto.

The male portion 20 includes a base 40 and a magnet 42.

The base 40 of the male portion 20 is disk-shaped, and is for replicating a button by having four blind bores 41.

The magnet 42 of the male portion 20 is disk-shaped, radially larger than the base 40 of the male portion 20, and has a perimeter 44 with an annular groove 46 for receiving the perimeter 15 of the preexisting button hole 14 of the article of clothing 16 for maintaining the magnet 42 of the male portion 20 in the preexisting button hole 14 of the article of clothing 16.

Method for Using the Magnetic Button 10

The method for using the magnetic button 10 with a preexisting button 12 and a preexisting button hole 14 associated with the preexisting button 14 that is held onto the article of clothing 16 by the thread 13 and the preexisting button hole 14 has the perimeter 15 can best be seen in FIGS. 1, 2, 6, 7, 8, and 9A-9C, and as such, will be discussed with reference thereto.

Figure 6:
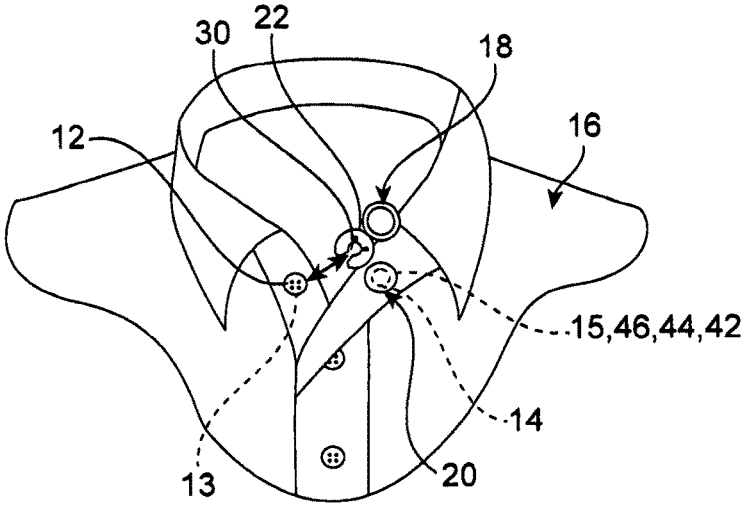
FIG. 6 is a diagrammatic perspective view of the initial step of being in the midst of applying the magnetic button of the embodiments of the present invention to the article of clothing.
Figure 7:
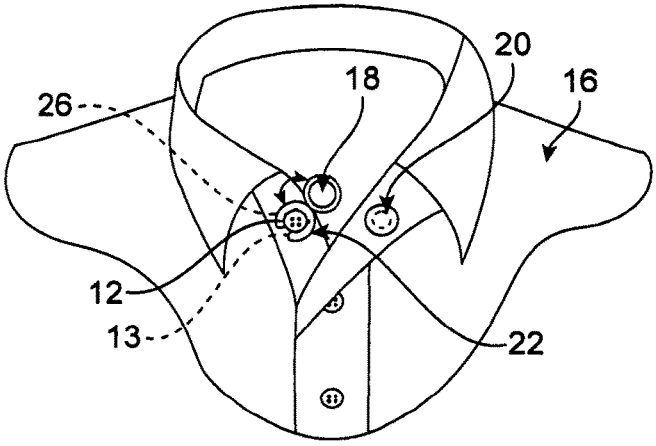
FIG. 7 is a diagrammatic perspective view of the next step of being in the midst of applying the magnetic button of the embodiments of the present invention to the article of clothing.
Figure 8:
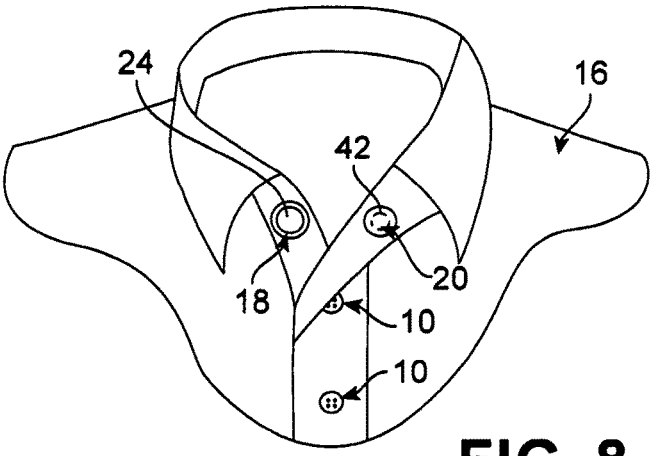
FIG. 8 is a diagrammatic perspective view of the final step of the magnetic button of the embodiments of the present invention to the article of clothing applied.

STEP 1: As shown in FIGS. 6 and 9A, slide the generally triangular-shaped cutout 30 of the base 22 of the female portion 18 over the thread 13 that is holding the preexisting button 12 onto the article of clothing 16;

STEP 2: As shown in FIGS. 7 and 9B, capture the thread 13 in the through bore 26 of the base 22 of the female portion 18:

STEP 3: As shown in FIGS. 7 and 9B, position the preexisting button 12 of the article of clothing 16 onto the base 22 of the female portion 18;

STEP 4: As shown in FIGS. 1 and 9B, close the cover 24 of the female portion 18 onto the base 22 of the female portion 18 capturing the preexisting button 12 of the article of clothing 16 therebetween;

STEP 5: As shown in FIGS. 6 and 9C, insert the male portion 20 into the preexisting button hole 14 of the article of clothing 16 until the perimeter 15 of the preexisting button hole 14 of the article of clothing 16 sits in the annular groove 46 of the perimeter 44 of the magnet 42 of the male portion 20; and STEP 6: As shown in FIGS. 2, 8, and 9C, attach the male portion 20 to the female portion 18 by positioning the magnet 42 of the male portion 20 onto the cover 24 of the female portion 18.

Impressions

It will be understood that each of the elements described above or two or more together may also find a useful application in other types of constructions differing from the types described above.

While the embodiments of the present invention have been illustrated and described as embodied in a method of using a magnetic button for use with a preexisting button and a preexisting button hole associated with the preexisting button of an article of clothing, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features from the standpoint of prior art fairly constitute characteristics of the generic or specific aspects of the embodiments of the present invention.

The invention claimed is:

1. A method for using a magnetic button with a preexisting button and a preexisting button hole associated with the preexisting button that is held onto an article of clothing by a thread and the preexisting button hole has a perimeter, comprising the steps of:

a) sliding a generally triangular-shaped cutout of a base of a magnetic attractive female portion of the magnetic button over the thread that is holding the preexisting button onto the article of clothing;

b) capturing the thread in a central through bore of the base of the female portion;

c) positioning the preexisting button of the article of clothing onto the base of the female portion;

d) closing a cover of the female portion onto the base of the female portion capturing the preexisting button of the article of clothing therebetween;

e) inserting a male portion of the magnetic button into the preexisting button hole of the article of clothing until the perimeter of the preexisting button hole of the article of clothing sits in an annular groove of a perimeter of a magnet of the male portion of the magnetic button; and f) attaching the male portion to the female portion by positioning the magnet of the male portion onto the cover of the female portion.

2. The method of claim 1, wherein said female portion is for attaching to the preexisting button of the article of clothing.

3. The method of claim 1, wherein said male portion is magnetic, while said female portion is magnetic attractive, and being so, a location position of said male portion and said female portion are selective for allowing a user to merely put said male portion and said female portion together in a comfortable location by virtue of said female portion being magnetically attractive to said male portion being magnetic.

4. The method of claim 1, wherein said base of said female portion is disk-shaped.

5. The method of claim 1, wherein said base of said female portion has a perimeter.

6. The method of claim 5, wherein said generally triangular-shaped cutout of said base of said female portion extends divergently from, and opens into, said central through bore of said base of said female portion to, and opens into, said perimeter of said base of said female portion.

7. The method of claim 5, wherein said cover of said female portion has a perimeter.

8. The method of claim 7, wherein said perimeter of said cover of said female portion is attached to said perimeter of said base of said female portion by a living hinge.

9. The method of claim 7, wherein said cover of said female portion has a blind recess that is circular.

10. The method of claim 9, wherein said blind recess of said cover of said female portion extends therein concentrically to said perimeter of said cover.

11. The method of claim 9, wherein said blind recess of said cover of said female portion is for receiving the preexisting button of the article of clothing when said cover of said female portion is closed over said base of said female portion.

12. The method of claim 1, wherein said base of said female portion has a pair of expansion through slots.

13. The method of claim 12, wherein said pair of expansion through slots of said base of said female portion extend slightly radially outwardly from, and open into, said central through bore of said base of said female portion, in a direction opposite to that of said generally triangular-shaped cutout of said base of said female portion.

14. The method of claim 1, wherein said generally triangular-shaped cutout of said base of said female portion is for receiving the thread holding on the preexisting button of the article of clothing for maintaining said base of said female portion on the preexisting button of the article of clothing.

15. The method of claim 1, wherein said cover of said female portion is disk-shaped to match that of said base of said female portion.

16. The method of claim 1, wherein said cover of said female portion is made from a magnetically attractive material.

17. The method of claim 1, wherein said male portion includes a base.

18. The method of claim 17, wherein said magnet of said male portion is disk-shaped.

19. The method of claim 17, wherein said magnet of said male portion is radially larger than said base of said male portion.

20. The method of claim 17, wherein said base of said male portion is disk-shaped.

21. The method of claim 17, wherein said base of said male portion is for replicating a button by having four blind bores.

* * * * *